US007441601B2

(12) United States Patent
George et al.

(10) Patent No.: US 7,441,601 B2
(45) Date of Patent: Oct. 28, 2008

(54) PERFORATION GUN WITH INTEGRAL DEBRIS TRAP APPARATUS AND METHOD OF USE

(75) Inventors: Kevin George, Cleburne, TX (US); Nathan Clark, Mansfield, TX (US); James Rollins, Fort Worth, TX (US); David S. Wesson, Fort Worth, TX (US)

(73) Assignee: Geodynamics, Inc., Millsap, TX (US)

( * ) Notice: Subject to any disclaimer, the term of this patent is extended or adjusted under 35 U.S.C. 154(b) by 0 days.

(21) Appl. No.: 11/372,883

(22) Filed: Mar. 10, 2006

(65) Prior Publication Data

US 2007/0079966 A1 Apr. 12, 2007

Related U.S. Application Data

(60) Provisional application No. 60/681,553, filed on May 16, 2005.

(51) Int. Cl.
*E21B 43/116* (2006.01)

(52) U.S. Cl. ..... 166/297; 166/55; 166/55.1; 166/99; 175/4

(58) Field of Classification Search ..... 166/297, 166/298, 55, 55.1, 55.2, 99; 175/2, 4.53, 175/308

See application file for complete search history.

(56) References Cited

U.S. PATENT DOCUMENTS

| | | | | |
|---|---|---|---|---|
| 3,630,282 | A * | 12/1971 | Lanmon, II | 166/297 |
| 6,220,370 | B1 * | 4/2001 | Wesson et al. | 175/4.52 |
| 6,487,973 | B1 * | 12/2002 | Gilbert et al. | 102/312 |
| 2004/0211565 | A1 * | 10/2004 | Kash | 166/297 |
| 2007/0107589 | A1 * | 5/2007 | Rospek et al. | 89/1.15 |

FOREIGN PATENT DOCUMENTS

WO WO 2005/033472 A1 4/2005

* cited by examiner

*Primary Examiner*—David J. Bagnell
*Assistant Examiner*—David Andrews
(74) *Attorney, Agent, or Firm*—David W. Carstens; Carstens & Cahoon, LLP

(57) ABSTRACT

An improved perforation gun includes an outer gun barrel, which is used in conjunction with an inner movable charge carrier or an inner movable sleeve to trap virtually all of the debris created by the firing of the perforation gun. The charge carrier has a plurality of explosive charges initially aligned with complementary, pre-existing holes in the wall of the charge carrier, which are initially aligned with complementary, pre-existing scalloped sections of the outer gun barrel.

6 Claims, 10 Drawing Sheets

PERFORATION GUN WITH INTEGRAL DEBRIS TRAP APPARATUS AND METHOD OF USE

CROSS-REFERENCE TO RELATED APPLICATION

This application claims the benefit of and priority to a U.S. Provisional Patent Application No. 60/681,553 filed May 16, 2005, the technical disclosure of which is hereby incorporated herein by reference.

BACKGROUND OF THE INVENTION

1. Technical Field of the Invention

The present invention relates generally to perforation guns that are used in the oil and gas industry to explosively perforate well casing and underground hydrocarbon bearing formations, and more particularly to an improved method and an improved apparatus for explosively perforating a well casing and its surrounding underground hydrocarbon bearing formation while limiting the amount of explosion debris in the well bore and hydrocarbon bearing formation following perforation.

2. Description of the Related Art

During the completion of an oil and/or gas well, it is common to perforate the hydrocarbon containing formation with explosive charges to allow inflow of hydrocarbons to the well bore. These charges are loaded in a perforation gun and are typically shaped charges that produce an explosive formed penetrating jet in a chosen direction.

FIG. 1 illustrates a perforation gun consisting of a cylindrical carrier 14 hanging from a cable 20. At the well site, the explosive charges 16 are placed into the charge carrier 14, and the charge carrier 14 is then lowered into oil and gas well casing to the depth of the hydrocarbon bearing formation 12. The exploding charges 16 fire outward from the charge carrier 14 and the force from each charge punctures holes 24 in the wall 18 of the casing and the hydrocarbon bearing formation 12, which allows oil, gas, water and/or minerals to flow into the casing from the hydrocarbon bearing formation 12.

While perforation guns do increase fluid production from hydrocarbon bearing formations, the effectiveness of traditional perforation guns is limited by the fact that the firing of a perforation gun can leave behind "debris" inside the casing and the hydrocarbon bearing formation 12. This debris can cause significant operational difficulties for the well operator and has to be cleaned out of the well at a significant cost. FIG. 2 shows a traditional hollow carrier perforation gun 14B, positioned adjacent to a hydrocarbon bearing formation 12 as shown in FIG. 1, after it has been fired and the explosive charge receiving areas 16B have been damaged. The debris 22 left behind is essentially blast shrapnel, which are pieces of the charge carrier 14B, the explosive charges, and the explosive charge receiving areas 16B that obstruct the production of oil and gas from the well.

Prior art has proposed an apparatus used to trap this debris before it enters the well casing and hydrocarbon bearing formation, which is disclosed in Rospek et. al. PCT Application WO 2005/033472. FIG. 3 is a depiction of the perforation gun described in Rospek '472. It is composed of an outer gun barrel 210 with a coaxial interior hollow charge carrier 212. The explosive charges 214 are inside the charge carrier 212. FIG. 4 shows the perforation gun of FIG. 3 as it is being fired. When the explosive charges 214B contained inside the charge carrier 212 are detonated, the explosions 226 create holes 224 in both the interior charge carrier 228 and the outer gun barrel 230. The perforation gun then theoretically traps the debris 22 from the detonation within the charge carrier 212 by moving the entire charge carrier 212 (including the charge-housing portion 232 of the gun that originally housed the explosive charges) along the axis it shares with the outer gun barrel 210 until the holes 224 created by the charges 228 and 230 are no longer aligned. The Rospek '472 application discloses that the movement of the interior charge carrier 212 can theoretically be actuated using explosives, a strained spring, or the force from the explosive charges 214B. Such actuating force must be great enough to break the shear pin 216, 216B and move the charge carrier 212 a distance 222 (which distance must be large enough to allow movement sufficient to seal the holes created by the charges 228 and 230) until the bottom surface 218 of the charge carrier 212 impacts the endplate 220. The Rospek '472 application also teaches that the walls of both the outer gun barrel 210 and the charge carrier 212 are solid before the perforation charges 214 are detonated.

A need exists for an improved and more comprehensive and more efficient design for a debris trapping perforation gun. A further need exists for an improved, more comprehensive and more efficient method of operation of the debris trapping perforation gun.

SUMMARY OF THE INVENTION

The present invention is thus directed to an improved perforation gun, which traps debris created by the explosion inside the gun. One embodiment overcomes many of the disadvantages of the Rospek '472 prior art by pre-drilling holes in the interior charge carrier. The holes in the charge carrier allow the explosive charges to easily pass through the charge carrier. This reduces or eliminates the damage done to the charge carrier by the explosive charges, which in turn allows the charge carrier to shift inside the gun with less resistance than the charge carrier in the Rospek '472 device. This also prevents reduced shaped charge performance as would happen in the Rospek '472 device.

The present invention is also an improvement over the Rospek '472 prior art through another embodiment, which seals the holes in the outer gun barrel using a movable inner sleeve. The inner sleeve has pre-drilled holes and shifts to close the holes created in the outer gun barrel by the explosive charges while holding the charge carrier portion of the gun in place. The shifting inner sleeve with pre-drilled holes also moves with less resistance and more success than the charge carrier in Rospek '472.

BRIEF DESCRIPTION OF THE DRAWINGS

A more complete understanding of the method and apparatus of the present invention may be had by reference to the following detailed description when taken in conjunction with the accompanying drawings, wherein.

Figure 1:
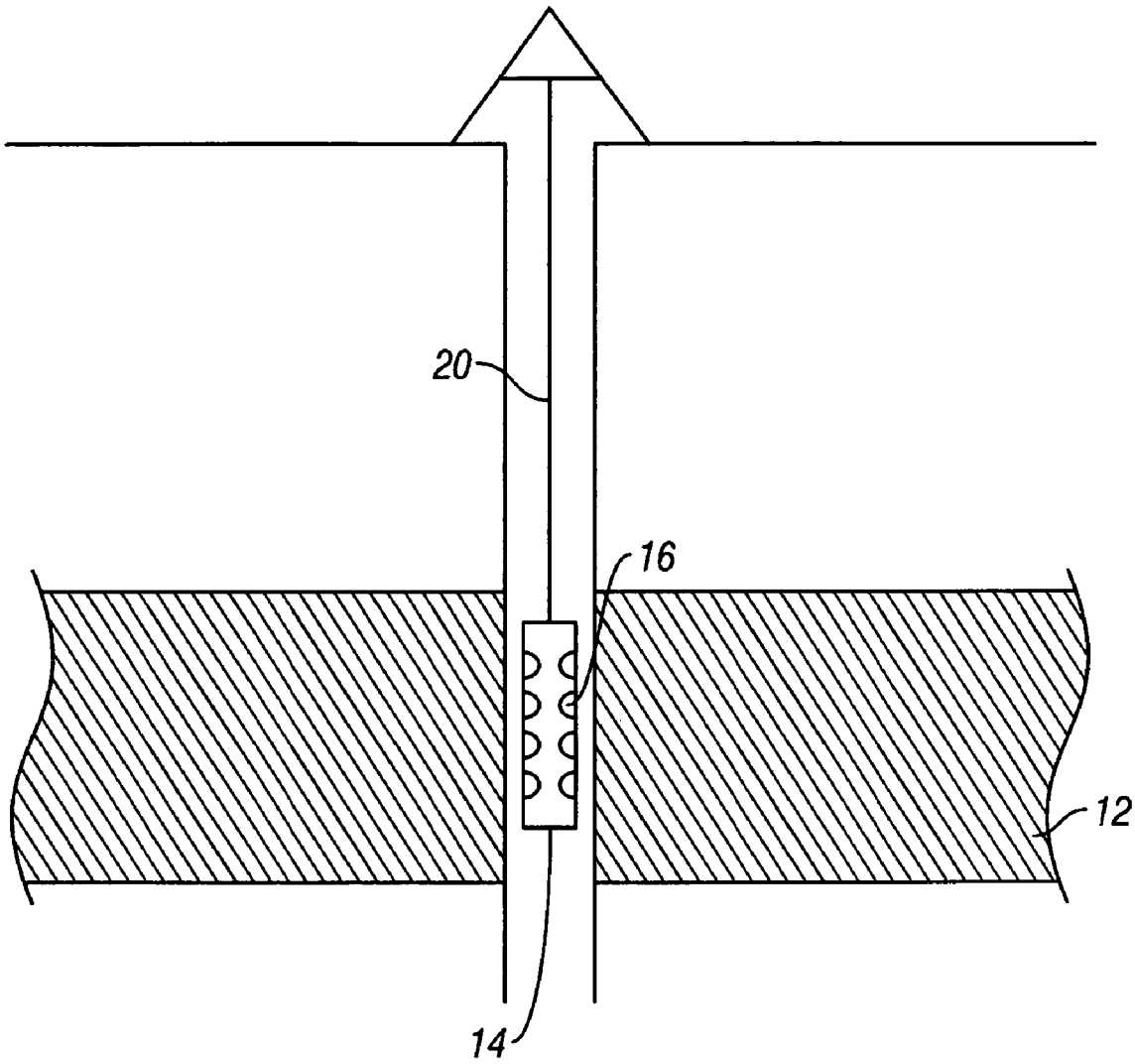
FIG. 1 (Prior Art)
FIG. 1 is a cross-sectional view of a perforation gun inside a well casing.
Figure 2:
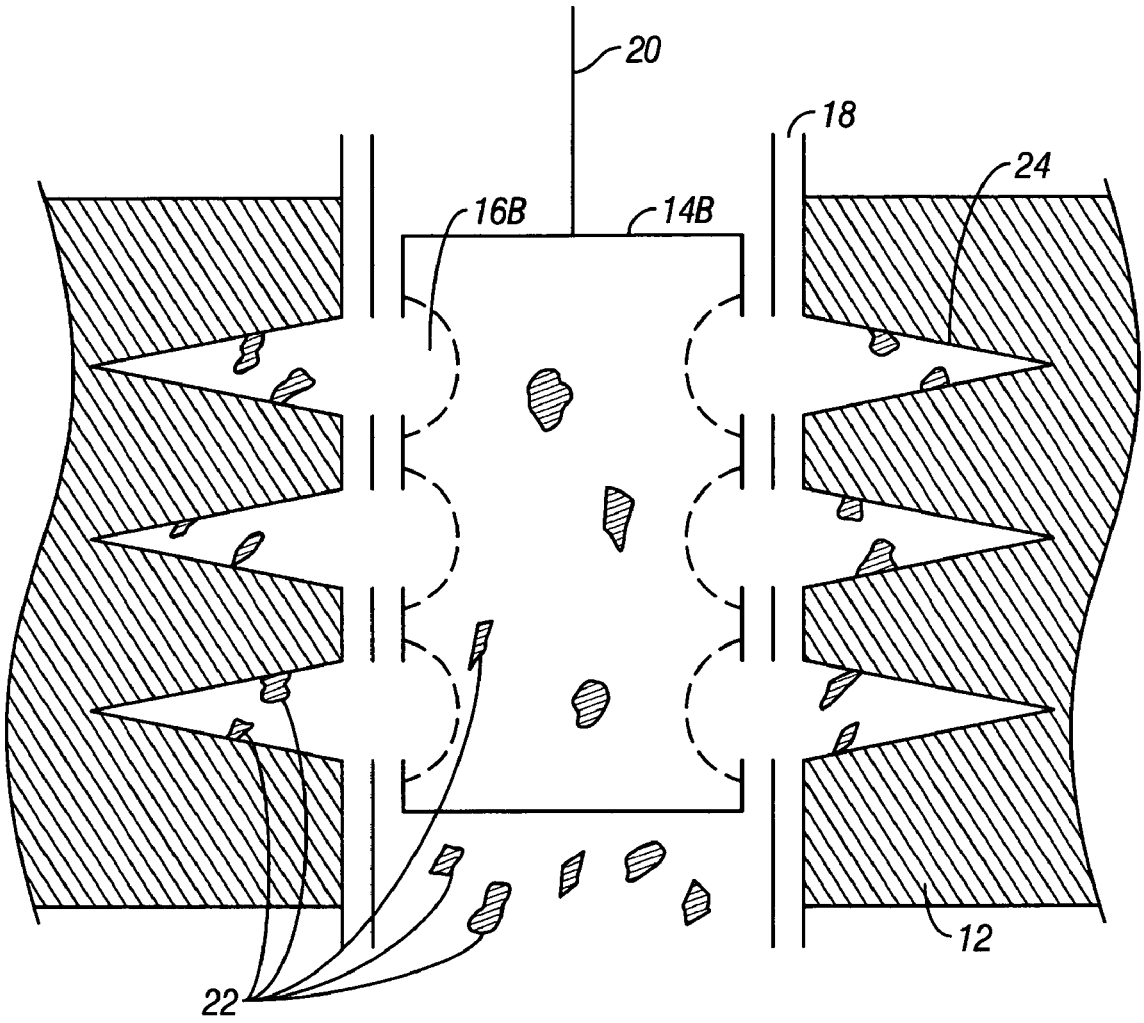
FIG. 2 (Prior Art)
FIG. 2 is a cross-sectional close-up view of a prior art conventional perforation gun right after it has been detonated inside a well casing.
Figure 3:
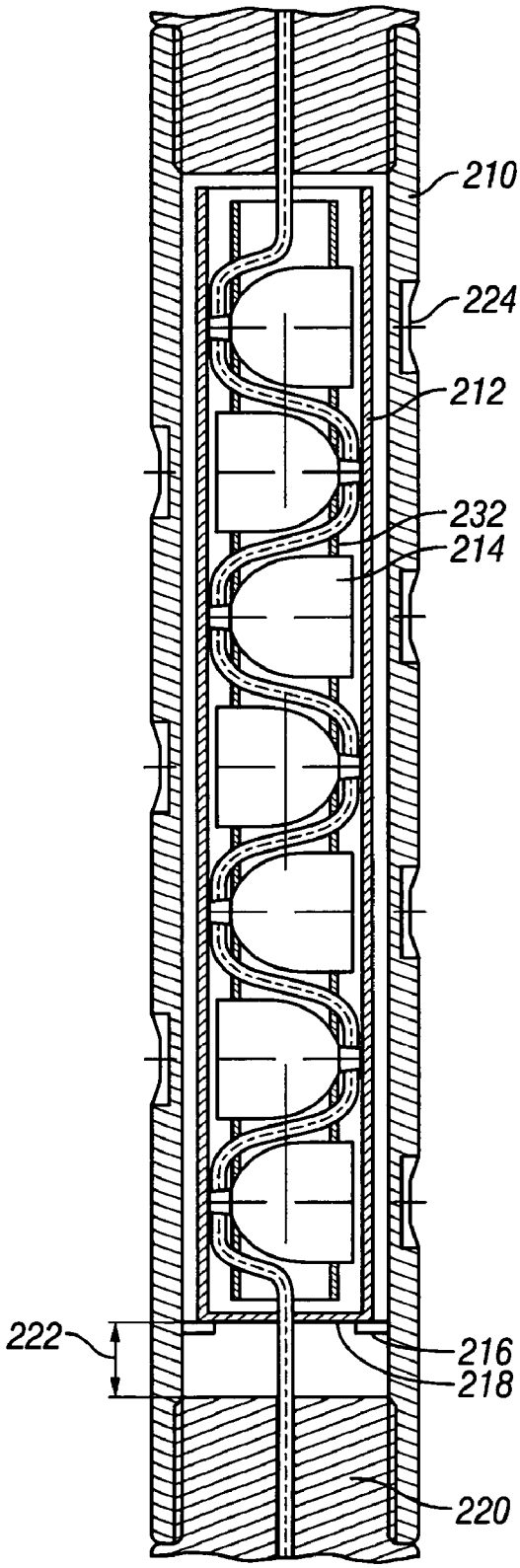
FIG. 3 (Prior Art)
FIG. 3 is a cross-sectional view of the Rospek '472 prior art perforation gun before firing.
Figure 4:
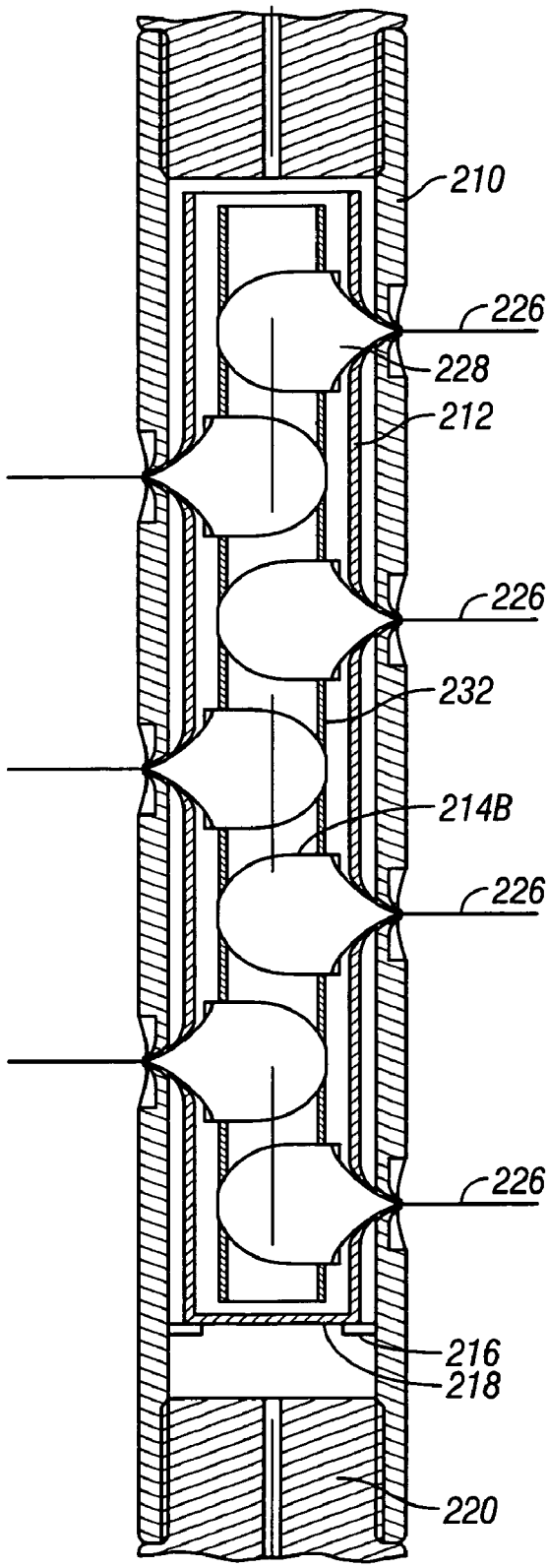
FIG. 4 (Prior Art)
FIG. 4 is a cross-sectional view of the Rospek '472 prior art perforation gun shown in FIG. 3 as it is firing.
Figure 5:
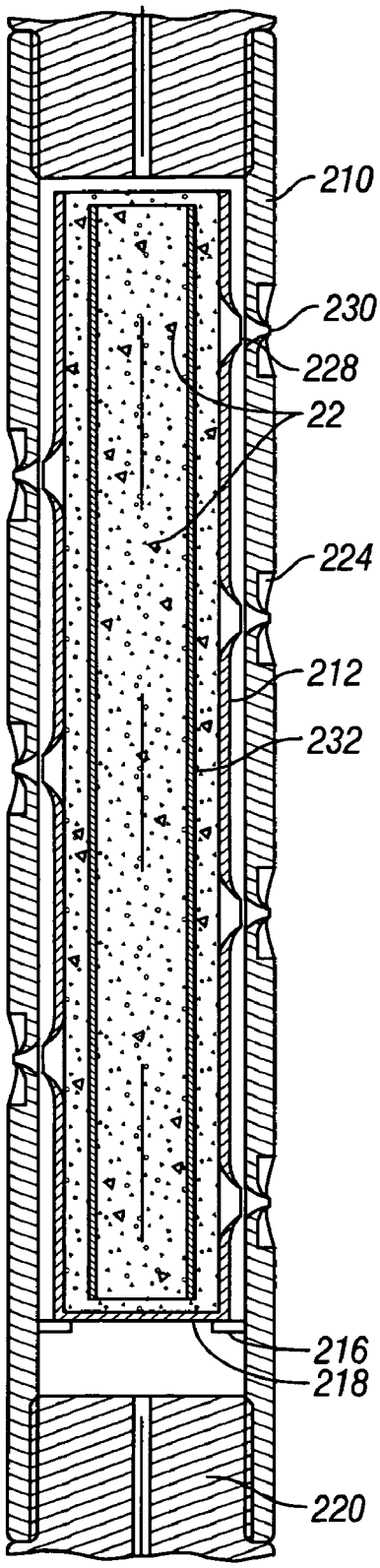
FIG. 5 (Prior Art)
FIG. 5 is a cross-sectional view of the Rospek '472 prior art perforation gun shown in FIG. 3 immediately after firing.
Figure 6:
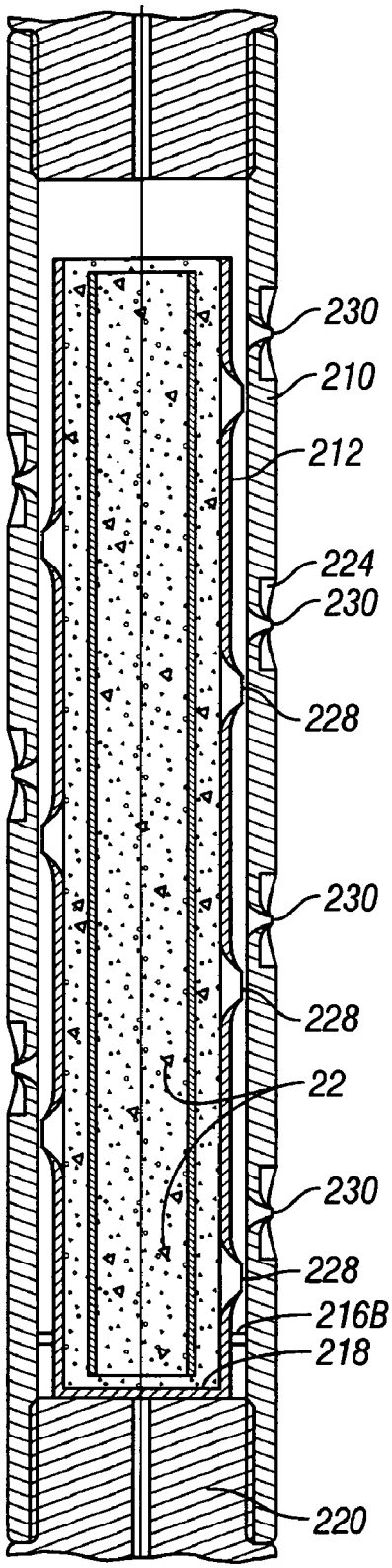
FIG. 6 (Prior Art)
FIG. 6 is a cross-sectional view of the Rospek '472 prior art perforation gun shown in FIG. 3 after the inner tube has shifted to trap the debris.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

The present invention involves an improved debris trapping perforation gun and the unique charge carrier or inner sleeve it incorporates. The invention produces superior debris trapping results because the pre-drilled holes in the charge carrier or inner sleeve, as appropriate, limits or eliminates deformations caused by the explosive charges which allows the charge carrier or inner sleeve to shift with more ease and success.

Referring initially to FIG. 1, the reference numeral 14 refers in general to a perforation gun (of which the present invention is one type), which has been lowered into a well bore to the depth of a hydrocarbon bearing formation 12.

Even though FIG. I shows a vertical well, one skilled in the art knows that the perforation gun of the present invention is equally well-suited for use in wells having other geometries such as deviated wells, inclined wells, or horizontal wells. Accordingly, use of directional terms such as above, below, up, down, upper, and lower and the like are used with reference to the embodiments illustrated in the figures and should not be construed as limitations on the invention. Also, even though FIG. 1 depicts an onshore operation, one skilled in the art will recognize that the present invention is equally well suited for use in offshore operations. In addition, although FIG. 1 depicts a single perforation gun, the principles of the present invention are applicable to perforation operations which utilize a series of perforation guns inside the same well casing. Finally, the number of shaped charges contained in any figure should not be viewed as a limitation on the invention. One skilled in the art knows that the number of shaped charges used in the present invention will vary according to the requirements of the specific application.

Figure 7:
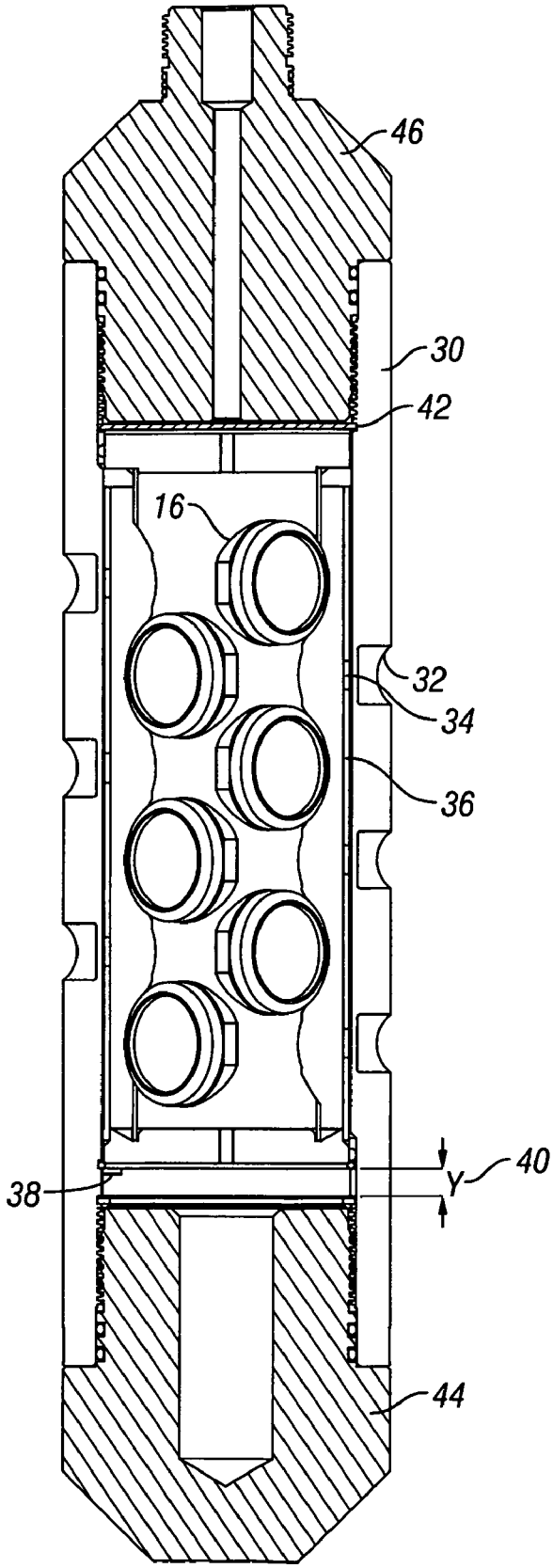
FIG. 7 is a cross-sectional view of one embodiment of the debris trapping perforation gun of the present invention before it has been fired.

In the first preferred embodiment, referring to FIG. 7, a charge carrier 36 is contained inside an outer gun barrel 30. The wall of the charge carrier 36 is geometrically similar to the wall of the gun barrel 30, with the outside diameter of the charge carrier 36 being slightly smaller than the inside diameter of outer gun barrel 30. The charge carrier 36 has a plurality of explosive charges 16, with each explosive charge 16 being aligned with a hole 34 in the wall of the charge carrier 36. Each hole 34 prevents any reduced performance of the adjacent explosive charge 16. Each hole 34 in the wall of the charge carrier 36 is also aligned with the scalloped sections 32 of the outer gun barrel 30. The scalloped sections 32 of the outer gun barrel 30 are sections of the outer gun barrel 30 wall that are thinner than other parts of the outer gun barrel 30 to allow the force from the explosive charge to pass through the outer gun barrel 30 more easily. The charge carrier 36 is held in place near or against the upper endplate 46 before firing by a stress failing connector, which is a connector designed to fail under a specific amount of stress (for example, a shear pin or pins 38) and allow the charge carrier 36 to shift axially along the axis it shares with the outer gun barrel 30. The charge carrier is initially held in place by the shear pin 38 a distance "Y" 40 between the lower end of the charge carrier 36 and the lower endplate 44. An optional propellant disk 42 can be placed between the charge carrier 36 and the upper endplate 46 to facilitate shifting of the charge carrier 36 after firing of the explosive charges.

Figure 8:
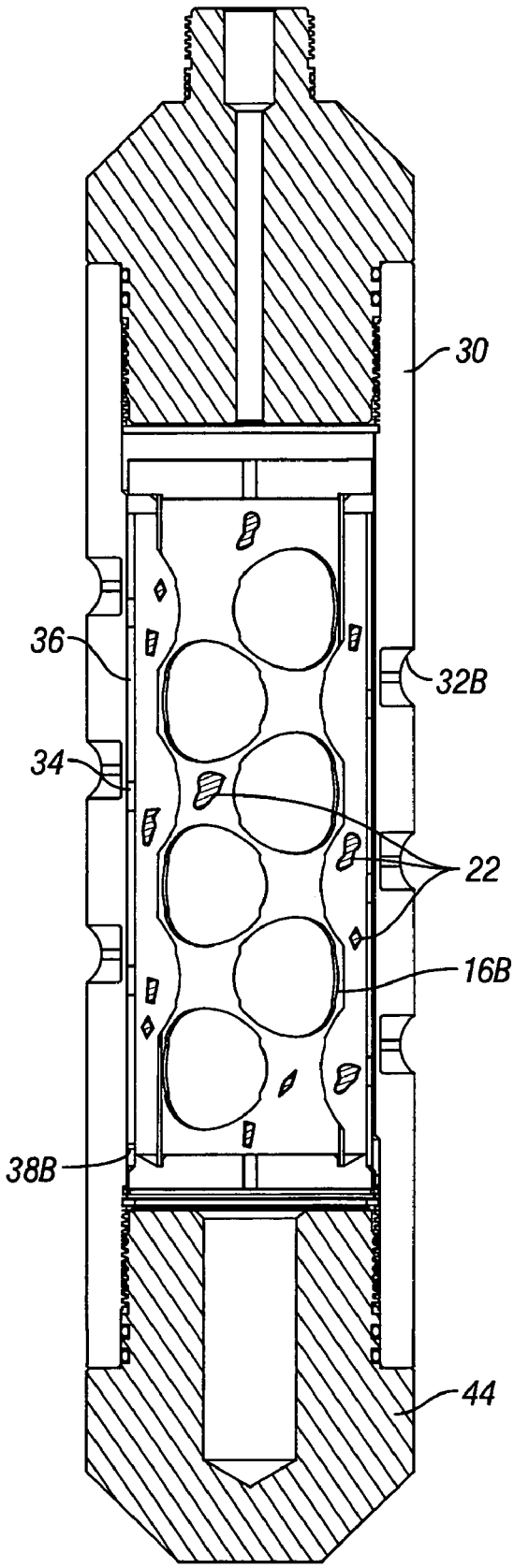
FIG. 8 is a cross-sectional view of the embodiment of the debris trapping perforation gun shown in FIG. 7 of the present invention after it has been fired and the charge carrier has shifted to trap the debris.

Referring now to FIG. 8, therein is depicted the first preferred embodiment of FIG. 7 of the present invention after the explosive charges 16 have been fired exposing the explosive charge receiving areas 16B and the charge carrier 36 has axially shifted. The force from the explosive charges have passed through the holes 34 in the charge carrier wall 36 and created holes in the scalloped sections 32B of the outer gun barrel 30. The shear pin 38B has been broken by force exerted on it by the charge carrier 36, said force being created either by the optional propellant disk 42 depicted in FIG. 7, or by ballistic pressure and shock created inside the carrier 36 by the firing of the explosive charges. The broken shear pin or pins 38B allows the charge carrier 36 to move axially along the axis it shares with the outer gun barrel 30. The distance the charge carrier moves is determined by the distance Y 40 depicted in FIG. 7. The distance Y 40 should be such that after the charge carrier 36 shifts, the holes 34 in the charge carrier wall 36 are not aligned with the holes in the scalloped sections 32B of the outer gun barrel 30, but not such that the holes 34 in the charge carrier 36 re-align with different holes in the scalloped sections 32B of the outer gun barrel 30 after the charge carrier 36 shifts, thereby sealing off the interior of the perforation gun from its surroundings. The debris 22 created by the explosive charges is now trapped inside the charge carrier 36.

Figure 9:
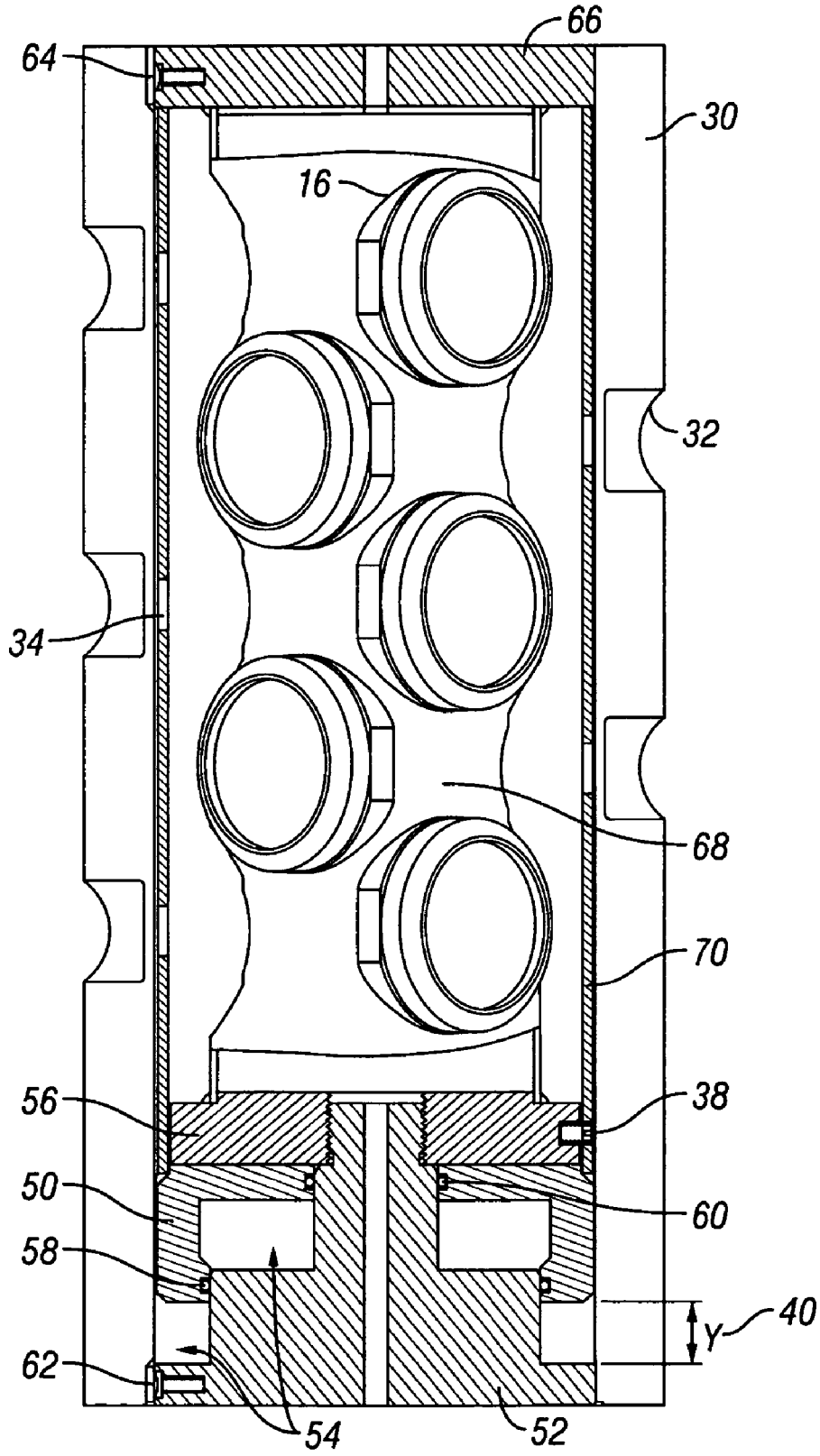
FIG. 9 is a cross-sectional view of another embodiment of the debris trapping perforation gun of the present invention before it has been fired.

In the second preferred embodiment, referring to FIG. 9, a charge mount 68 with explosive charges 16 is fixed in position between the upper endplate 66 and the lower endplate 52 by means of a mounting plate 56. The upper endplate 66 and the lower endplate 52 are held in place by alignment screws 64 and 62, respectively. Unlike the charge carrier 36 of the first preferred embodiment depicted in FIG. 7 and FIG. 8, the charge mount 68 of the second preferred embodiment does not shift axially after the explosive charges have been fired. Instead, located immediately inside the outer gun barrel 30 is an inner sleeve 70, the wall of which is geometrically similar to the wall of the outer gun barrel 30, and which fits closely inside the outer gun barrel 30 (preferably about $\frac{1}{8}^{th}$ inch clearance between the outer wall of the inner sleeve 70 and the inner wall of the outer gun barrel 30). The outer gun barrel 30 has scalloped sections 32 (thin sections of the outer gun barrel 30 which allow the force from the explosive charge to pass through the outer gun barrel 30 more easily) which are initially aligned with the explosive charges 16 located on the charge mount 68. The inner sleeve 70 contains holes 34 that are initially aligned with the explosive charges 16 and the scalloped sections 32 of the outer gun barrel 30. The inner sleeve 70 is permanently affixed to a guideplate 50 by means known to those skilled in the art (for example, welding). The guideplate 50 and the lower endplate 52 are geometrically shaped such that the guideplate 50 is the male/female counterpart of the lower endplate 52. The inner sleeve 70 and guideplate 50 are held in place initially by a stress failing connector (for example, a shear pin 38) which is anchored to the mounting plate 56, and two O-rings 58 and 60. The lower surface of the guideplate 50 is initially located a distance Y 40 from the corresponding upper surface of the lower endplate 52 leaving empty space 54 between the lower surface of the guideplate 50 and the upper surface of the lower endplate 52.

FIG. 9 of the present invention after explosive charges 16 have been fired and the inner sleeve 70 and guideplate 50 have axially shifted. The force from the explosive charges have passed through the holes 34 in the inner sleeve 70 and created holes in the scalloped sections 32B of the outer gun barrel 30. The shear pin 38B has been broken by force exerted on it by the inner sleeve 70 and guideplate 50, said force being created by the increased hydraulic pressure created in the well bore by the firing of the explosive charges. The air chamber 54B that exists between the O-rings 58 and 60 allows the explosive pressure from the explosive charges and the hydrostatic pressure in the well bore to shift the guideplate 50 (which is connected to the inner sleeve 70). The broken shear pin or pins 38B allow the inner sleeve 70 and guideplate 50 to move axially along the axis they share with the outer gun barrel 30. The force required for the shear pin or pins 32 to support the carrier assembly until the explosive charges have been fired is selected by those skilled in the art. The distance the inner sleeve 70 and guideplate 50 moves is determined by the distance Y 40 depicted in FIG. 9. The distance Y 40 should be such that when the inner sleeve 70 and guideplate 50 shifts, the holes 34 in the inner sleeve 70 are no longer aligned with the holes in the scalloped sections 32B of the outer gun barrel 30, but not such that the holes 34 in the inner sleeve 70 re-align with different holes in the scalloped sections 32B of the outer gun barrel 30 after the inner sleeve 70 and guideplate 50 shifts, thereby sealing off the interior of the perforation gun from its surroundings. The debris 22 created by the explosive charges is now trapped inside the inner sleeve 70.

It should be understood by one skilled in the art that in order for the present invention to be used in practice, explosive charges 16 must be placed in the explosive charge receiving areas 16B before the perforation gun is placed into the well bore. Explosive charges used in the industry vary widely and it is understood by one skilled in the art that a plurality of different explosive charges is within the scope of the present invention.

Even though the figures described above have depicted all of the explosive charge receiving areas as having uniform size, it is understood by those skilled in the art that, depending on the specific application, it may be desirable to have different sized explosive charges in the perforation gun. Also, even though the above described figures have depicted a uniform axial distance between each of the explosive charge receiving areas, it is understood by those skilled in the art that, depending on the specific application, it may be desirable to have varied axial spacing between the explosive charges.

It is also understood by those skilled in the art that several variations can be made in the foregoing without departing from the scope of the invention. For example, the particular number and location of the explosive charges can be varied within the scope of the invention. Also, the particular techniques that can be used to fire the explosive charges within the scope of the invention are conventional in the industry and understood by those skilled in the art.

It will now be evident to those skilled in the art that there has been described herein an improved perforation gun that reduces the amount of debris left in the well bore and perforations in the hydrocarbon bearing formation after the perforation gun is fired.

Although the invention hereof has been described by way of preferred embodiments, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention

We claim:

1. A perforation gun assembly comprising:

an outer gun barrel;

an upper endplate connected to one end of said outer gun barrel;

a lower endplate connected to an end of said outer gun barrel opposite said upper endplate;

a mounting plate immovably mounted inside said outer gun barrel between said upper endplate and said lower endplate;

a charge mount immovably mounted to said mounting plate inside the outer gun barrel between said upper endplate and said mounting plate, said charge mount having a plurality of explosive charge receiving areas;

an inner sleeve slidably mounted inside said outer gun barrel, said inner sleeve being geometrically similar to said outer gun barrel, said inner sleeve having a plurality of holes, each hole being aligned with a corresponding explosive charge receiving area;

a guideplate slidably mounted inside said outer gun barrel between said mounting plate and said lower endplate, said guideplate affixed to said inner sleeve, and said guideplate being the male/female counterpart of said lower endplate; and a stress failing connector holding said inner sleeve and said guideplate in place against or near said upper endplate.

2. The perforation gun assembly of claim 1 wherein said outer gun barrel has scalloped sections in its outer wall, with each said scalloped section located on said outer gun barrel in an area corresponding to an explosive charge receiving area of said charge mount.

3. The perforation gun assembly of claim 1 wherein said stress failing connector is at least one shear pin.

4. The perforation gun assembly of claim 1 wherein a trapped air chamber inside said perforation gun assembly allows said guideplate to shift in response to force created by increased pressure inside said perforation gun assembly.

5. A method for assembling a perforating gun for creating a perforation cavity in an underground hydrocarbon bearing formation behind a well casing, said method for assembling comprising the steps of:

(a) providing a lower endplate;

(b) affixing a guideplate to an inner sleeve, with said guideplate being the male/female counterpart to said lower endplate, with said inner sleeve being geometrically similar to an outer gun barrel, and with said inner sleeve containing a plurality of preexisting holes;

(c) placing said guideplate and said inner sleeve against said lower endplate such that the male/female counterpart portions of said guideplate and lower endplate abut each other;

(d) affixing a mounting plate immovably to said lower endplate with said guideplate located between said lower endplate and said mounting plate;

(e) placing explosive charges and a detonator for said explosive charges inside a charge mount, with each explosive charge being placed in an explosive charge receiving area of said charge mount;

(f) mounting said charge mount immovably to said mounting plate;

(g) affixing said inner sleeve to said mounting plate using a stress failing connector whereby said inner sleeve and said guideplate are positioned such that said holes in said inner sleeve are aligned with said explosive charges, and whereby said holes are not aligned with said explosive charges after said inner sleeve shifts;

(h) affixing said outer gun barrel to said lower endplate;

(i) affixing an upper endplate to said outer gun barrel; and (j) positioning the outer gun barrel, upper endplate, lower endplate, explosive charges, charge mount, mounting plate, inner sleeve, and guideplate in a well casing adjacent to an underground hydrocarbon bearing formation.

6. The method of claim 5 comprising the additional step of firing the explosive charges, thereby creating the perforation cavities, causing the inner sleeve and guideplate to axially shift along the axis they share with the outer gun barrel and trap the debris created by the firing of the explosive charges inside the inner sleeve.

* * * * *

UNITED STATES PATENT AND TRADEMARK OFFICE

CERTIFICATE OF CORRECTION

PATENT NO. : 7,441,601 B2
APPLICATION NO. : 11/372883
DATED : October 28, 2008
INVENTOR(S) : Kevin George et al.

Figure 10:
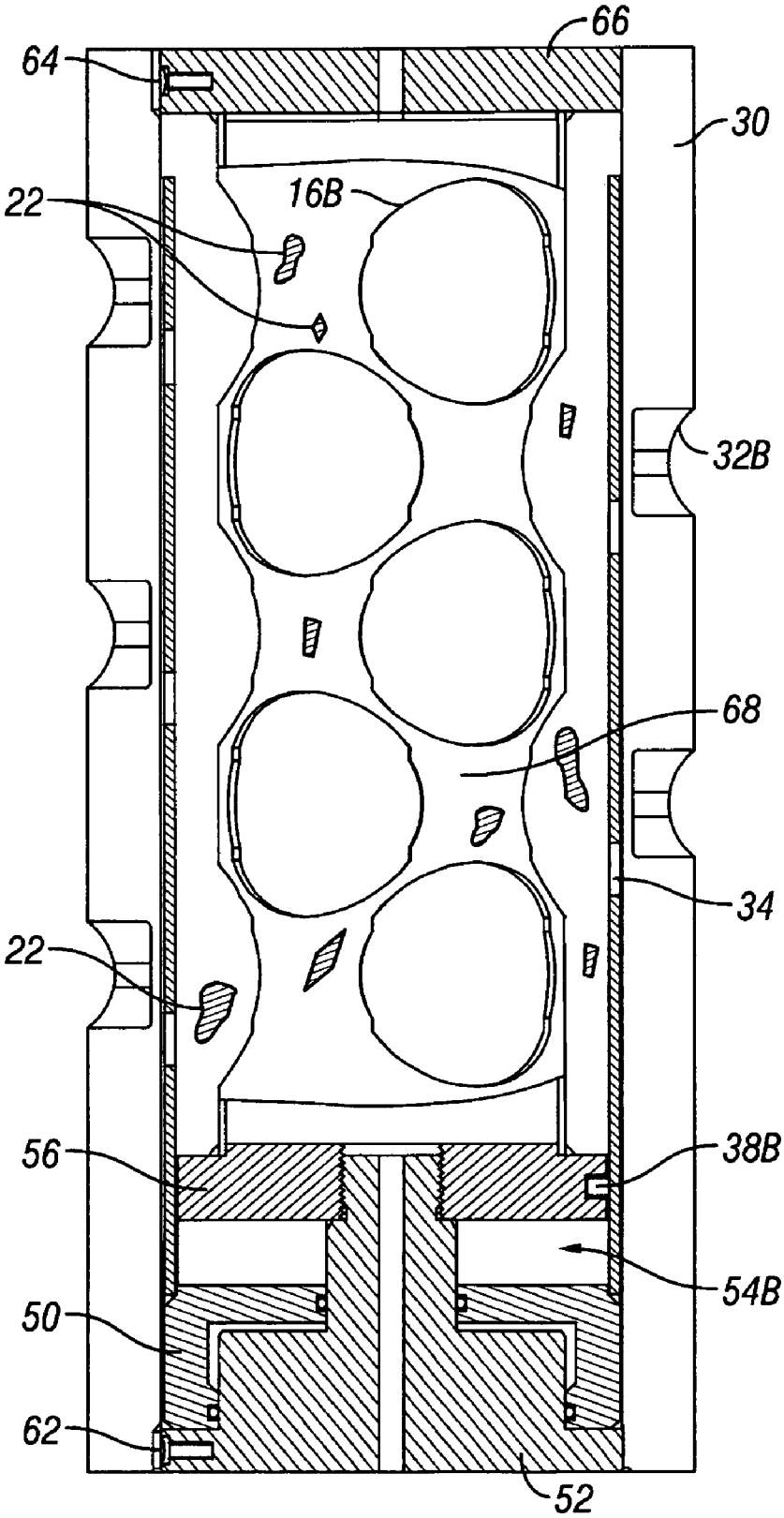
FIG. 10 is a cross-sectional view of the embodiment of the debris trapping perforation gun shown in FIG. 9 of the present invention after it has been fired and the inner sleeve has shifted to trap the debris.

It is certified that error appears in the above-identified patent and that said Letters Patent is hereby corrected as shown below:

Column 3, line 52, please replace "FIG. I" with --FIG. 1-- therefore.
Column 5, line 3, please add --Referring now to FIG. 10, therein is depicted the second preferred embodiment of" immediately before "FIG. 9.".

Signed and Sealed this

Third Day of February, 2009

JOHN DOLL
*Acting Director of the United States Patent and Trademark Office*